US006549140B1

(12) United States Patent
Koessler

(10) Patent No.: US 6,549,140 B1
(45) Date of Patent: Apr. 15, 2003

(54) INFANT PROTECTIVE BED

(76) Inventor: Thomas J. Koessler, 288 Rainprint La., Murrysville, PA (US) 15668

( * ) Notice: Subject to any disclaimer, the term of this patent is extended or adjusted under 35 U.S.C. 154(b) by 276 days.

(21) Appl. No.: 09/781,623

(22) Filed: Feb. 12, 2001

(51) Int. Cl.[7] ..... G08B 21/00

(52) U.S. Cl. ..... 340/687; 340/686.1; 340/573.1; 5/424; 5/425; 5/427; 5/655; 200/52 R

(58) Field of Search ..... 340/665, 666, 340/573.1, 573.4, 575, 687, 686.1; 5/101, 93.1, 655, 424, 425, 420, 427; 200/52 R, 51.12, 51 R, 61.58 R; 229/100, 101

(56) References Cited

U.S. PATENT DOCUMENTS 3,708,808 A * 1/1973 Irby ..... 5/95
4,780,706 A * 10/1988 Bollag ..... 340/666
5,057,819 A * 10/1991 Valenti ..... 340/573.1
5,233,710 A 8/1993 Bernard ..... 5/424
5,357,642 A * 10/1994 Clute ..... 5/655
5,450,640 A 9/1995 Patton ..... 5/655
5,640,726 A 6/1997 Fichner-Ratus ..... 5/426
5,713,090 A 2/1998 Rodgers ..... 5/505.1
5,822,817 A 10/1998 Carew ..... 5/732
5,937,465 A 8/1999 Carew ..... 5/732
6,097,294 A * 8/2000 Hilton ..... 340/573.1

* cited by examiner

*Primary Examiner*—Benjamin C. Lee
(74) *Attorney, Agent, or Firm*—Ronald S. Lombard

(57) ABSTRACT

A portable infant protective bed for protecting an infant especially when sleeping in close proximity to a sleeping adult is disclosed. The bed is sized to accommodate an infant and is provided with a resilient bumper member around the perimeter of the bed. The resilient bumper is provided with spring-loaded switch activation members as part of an alarm assembly that is so configured to sense if an adult rolls on to the bumper member, the alarm either sounds a loud alarm or vigorously vibrates the bumper member, or both, if desired.

18 Claims, 4 Drawing Sheets

INFANT PROTECTIVE BED

BACKGROUND OF THE INVENTION

The present invention relates to an infant bed and, in particular, to a portable infant protective bed for preventing an infant from being injured accidentally by an adult rolling over on the infant. Recently, this problem has gained attention in the media where there have been instances of infants being injured when sleeping in close proximity to a sleeping adult where the adult accidentally rolls over and injures the infant.

Various infant beds and mattress systems have been disclosed in the past. One such device is disclosed in U.S. Pat. No. 5,937,465, dated Aug. 17, 1999, issued to James M. Carew et al., which discloses a dual sleeping surface mattress, constructed to provide one sleeping surface which restricts the movement of an individual, such as small infants or adolescent children. The mattress body is reversible between upward and downward orientations which in one configuration supplies a sleeping recess for an infant and in the other configuration a mattress for adolescent children by filling the recess. The recess provides a restriction of movement of the infant away from the edges of a larger bed or a crib.

A bed enclosure for a baby is disclosed in U.S. Pat. No. 5,713,090, dated Feb. 3, 1998, issued to Kenneth R. Rodgers, which discloses a bed enclosure for a baby comprising a dome-shaped frame sized to extend over the baby sleeping on a bed with its parent. The dome-shaped frame is designed to protect the baby from being smothered by the parent inadvertently rolling on top of the baby while the parent is sleeping.

A collapsible child restrainer is disclosed in U.S. Pat. No. 5,233,710, dated Aug. 10, 1993, issued to Louise Bernard, which discloses a restrainer which forms an elongate triangular tube with a right angle between a base panel for resting on a resting surface and a vertical panel. The vertical panel provides a child restraining wall and the restrainer is connected to other similar restrainers at an angle of 90 degrees to form a rectangular crib area for infants.

A safety rail for sleeping beds is disclosed in U.S. Pat. No. 5,640,726, dated Jun. 24, 1997, issued to Lois Fichner-Rathus, which discloses a safety accessory for attachment to a sleeping bed for preventing the occupant from falling out. The invention provides for a guardrail that can be affixed to a bed, where the guardrail is held in place by a member that both crosses under the sleeping surface and additionally protrudes out of the other side of the bed to make contact with the other side of the bed. The side guard panel can be fitted with various utility apparatus including toys for children, electronic gear, sleep surveillance room monitors, pressure sensors, or other equipment desired to be collocated with the bed.

As can be seen from the hereinbefore described prior art, none of the devices are designed to awaken a sleeping adult upon contact with an infant bed should the adult accidentally roll over on the infant bed while sleeping in the adult bed.

SUMMARY OF THE INVENTION

The present invention provides a portable and protective bed for preventing an infant from accidentally being seriously injured when the infant and an adult or other larger person are sleeping together in close proximity, for example. The portable infant protective bed of the present invention includes a frame which includes a rigid base and rigid wall members attached to the base to form a central recessed portion. The base has a rigid exterior lip portion extending outwardly uniformly from the rigid wall members. A sleeping pad is housed within the central recessed portion, and supported by the base. A resilient bumper member is attached to and supported between the top of the rigid exterior lip portion of the base and the exterior of the rigid wall members. A cleanable cover is included and sized to snuggly encompass the pad and the resilient bumper member.

Pressure sensitive switch assemblies are attached to the wall members and housed within the resilient bumper member. The pressure sensitive switch assemblies desirably include pressure sensitive switch members attached to the wall members. The switch members have a pressure sensitive portion. The switch assemblies include a spring-loaded rigid activation members. The activation members include switch contact members in operative alignment with the pressure sensitive portions of the switch members. An energy source is connected in circuit with the pressure sensitive switch members. An alarm assembly is connected in circuit with the pressure sensitive switch members and the energy source, whereby when an infant is sleeping on the infant protective bed on the pad in close proximity to a sleeping adult, and, in the event that the adult rolls onto the resilient bumper member, the weight of the adult will cause at least one of the activation members to depress and contact one or more of the pressure sensitive switch members, thereby causing the alarm assembly to activate to wake the adult to prevent injury to the infant.

Preferably, the infant protective bed of the present invention has a rectangular base. Also the bumper member preferably comprises a resilient polyurethane foam, for example. The bumper member preferably is provided with voids in the polyurethane foam in predetermined position so that the switch members and other devices may be housed within the bumper member voids.

Preferably, each of the spring-loaded activation members includes an elongated rigid bar and spring-loaded support members disposed proximate the ends thereof. The spring-loaded support members have bottom portions affixed to the wall members. The elongated activation bars are each positioned close to the outer surface of the resilient bumper member in parallel relationship with one of the wall members.

Preferably, the spring-loaded support members each includes a coil spring mounted between one of the wall members and one of the rigid activation bars. The support member also includes a first tubular nut having a first threaded interior surface therein. The first tubular nut slideably passes through the coil spring and is in coaxial alignment with it. A first machine screw is engageable with the first threaded surface of the first tubular nut. The rigid bar has a first aperture therethrough proximate the ends thereof. The first machine screw passes through the first aperture and is engageable with the first threaded surface of the first tubular nut. The first tubular nut desirably has a blind head at one end. The wall members each have an opening therein sized to receive the head of the first tubular nut. Preferably, a base plate is attached to the wall member over the opening. The base plate has a second aperture through it. The first tubular nut slideably passes through the second aperture, whereby when the activation bar is depressed the first tubular nut is caused to travel thereby causing the switch contact member to engage the pressure sensitive portion of the switch member.

Preferably, the switch contact members each includes a second machine screw and a second tubular nut having a second threaded interior surface. The second tubular nut also has a second blind head attached at one end engageable with the pressure sensitive portion of the switch member. The rigid bar has a third aperture passing through it. The second machine screw passes through the third aperture of the rigid activation bar and is engageable with the second threaded surface of the second tubular nut.

Preferably, the alarm assembly includes motor-vibrator members attached to the spring-loaded activation bars. The motor-vibrator members are connected in circuit with the pressure sensitive switch members, whereby when the alarm assembly is energized by one of the activation bars being depressed and causing at least one of the switch contact members to contact the pressure sensitive portion of one of the switch members of one of the switch assemblies may cause the motor-vibrator member to be activated to wake the sleeping adult.

Preferably, the alarm assembly further includes a loud-sound-emitting device connecting in circuit with the pressure sensitive switch members, whereby when the alarm assembly is energized by one of the elongated bars being depressed and causing the switch contact members to contact the pressure sensitive portion of one of the switch members may cause the loud sound emitting device to be activated to wake the sleeping adult.

Preferably, the alarm assembly also includes a loud sound emitting device enabling switch connected in circuit with the loud-sound-emitting device to permit the loud-sound-emitting device to be used as part of the alarm assembly as desired.

The alarm assembly preferably further comprises a motor-vibrator member enabling switch connected in circuit with the motor vibrator members to permit the motor-vibrator members to be used as part of the alarm assembly as desired.

The alarm assembly desirably further includes a low battery warning light connected in circuit with the energy source. The energy source may be a battery, for example.

The bumper member preferably has a sloped adult contact surface portion of predetermined slope and position around the central recessed portion. Desirably, the sloped contact portions are from about 35 degrees to about 55 degrees from the vertical. Preferably, the upper surface of the elongated activation bars and the sloped contact portions of the bumper member are coplanar. The sides of the activation bars are desirably attached to the resilient polyurethane foam of the bumper member. Preferably contact adhesive is attached to the side of the activation bar to the resilient polyurethane foam of the bumper member, and also attaches the foam to the frame.

BRIEF DESCRIPTION OF THE DRAWINGS

For a better understanding of the invention, reference may be had to the accompanying drawings exemplary of the invention in which.

BRIEF DESCRIPTION OF THE PREFERRED EMBODIMENTS

Figure 1:
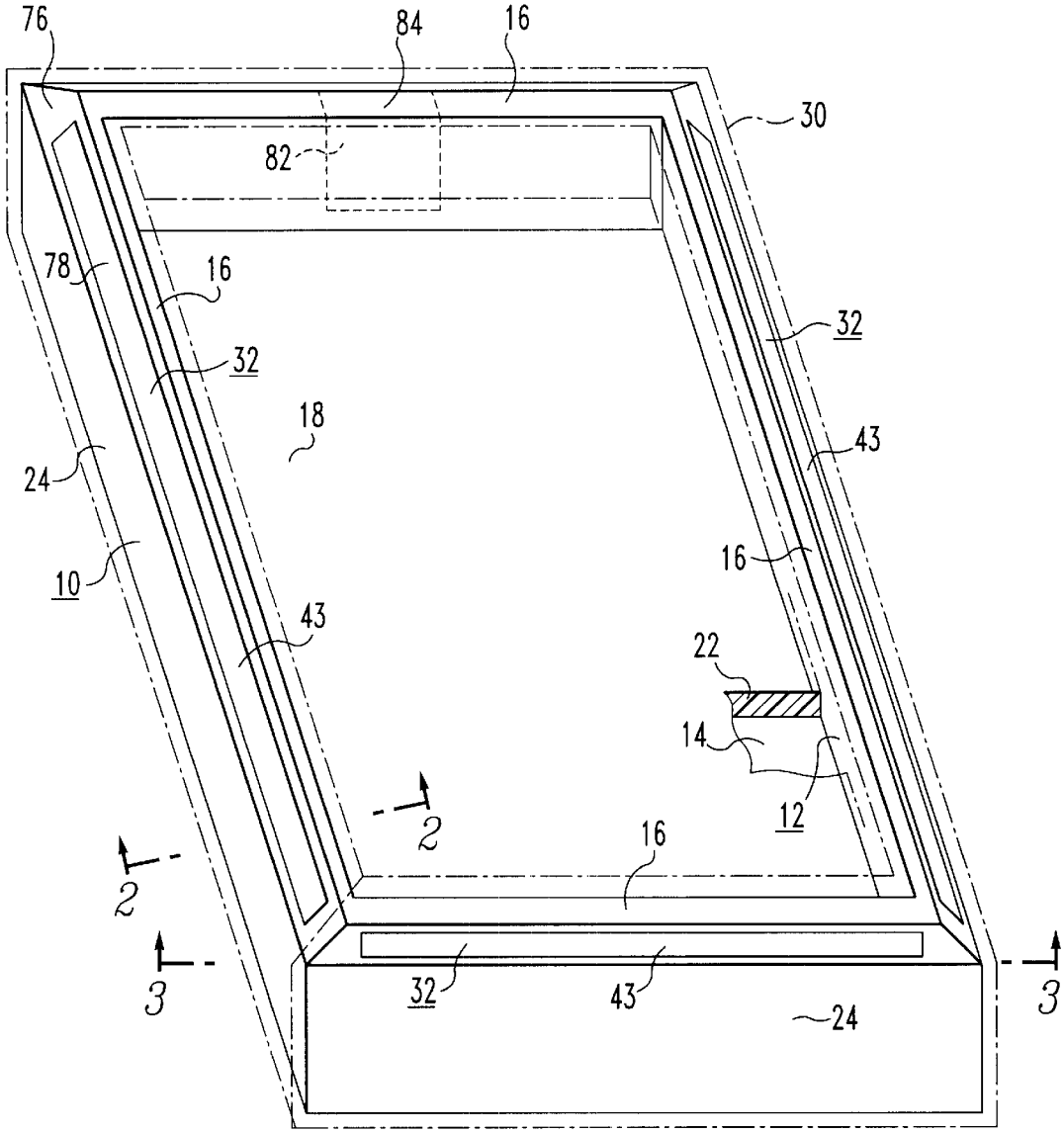
FIG. 1 is an isometric view of the portable infant protective bed of the present invention, partially in section.
Figure 2:
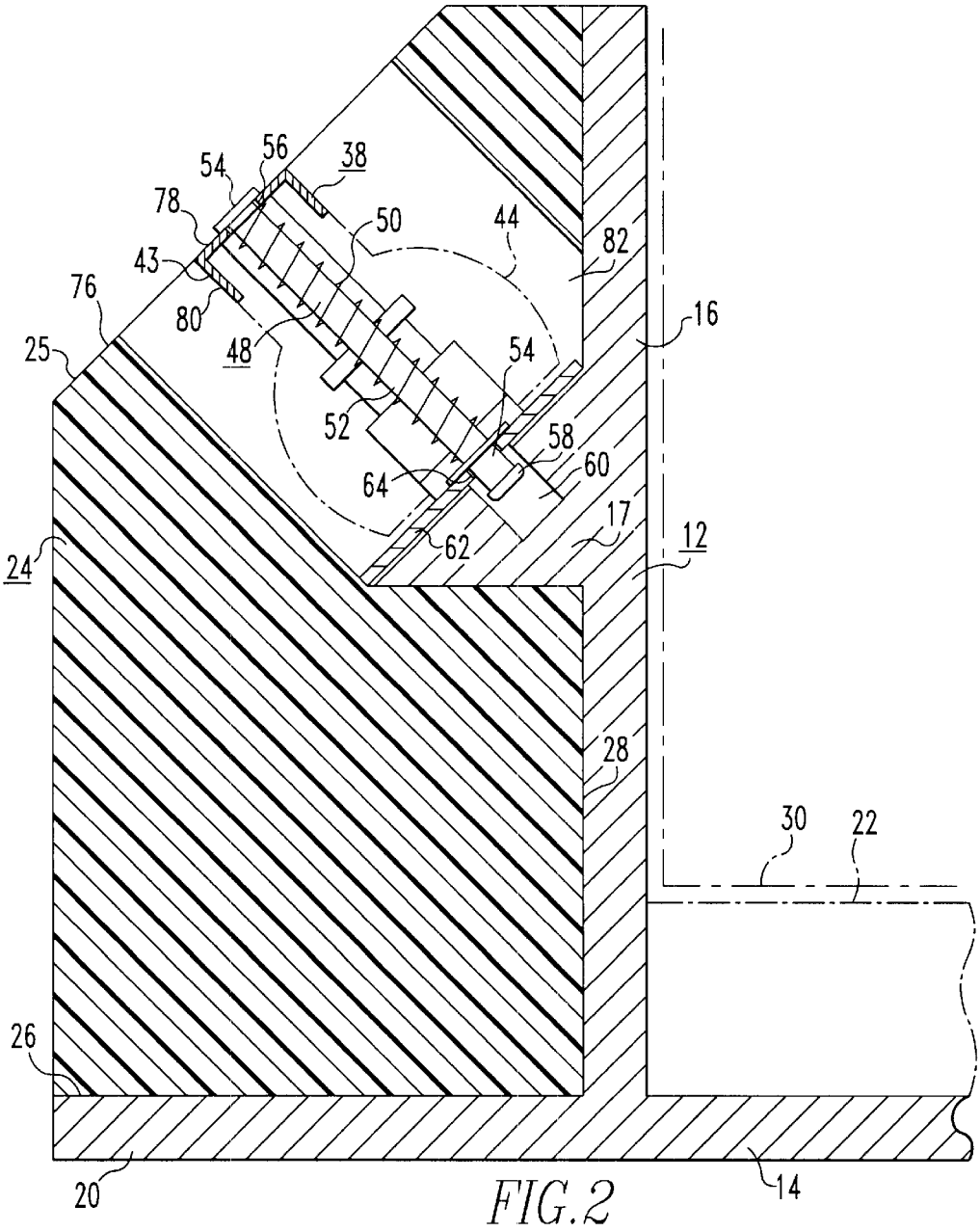
FIG. 2 is a cross-sectional view taken along the line 2—2 of FIG. 1.
Figure 3:
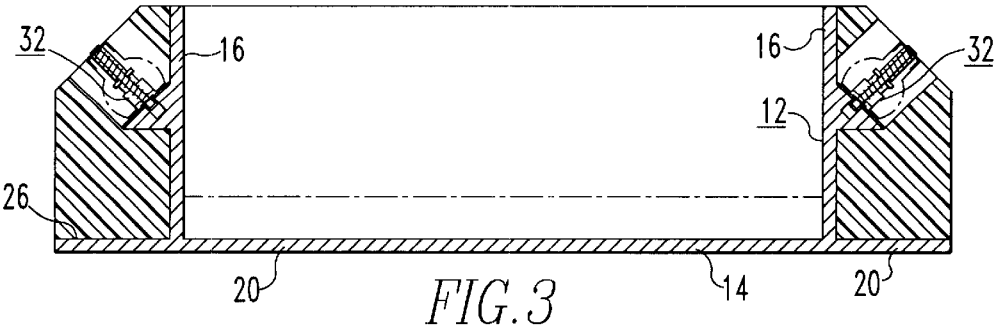
FIG. 3 is a cross-section view taken along the line 3—3 of FIG. 1.

With reference to FIGS. 1 and 2, there is shown a portable infant protective bed 10 including a frame 12 which includes a rigid base 14, and rigid wall members 16 which are attached to the base to form a central recessed portion 18. The frame may be made of any rigid material such as plywood or plastic, for example. The base 14 also has a rigid exterior lip portion 20 which extends outwardly uniformly from the rigid wall member 16 as shown in FIG. 2, for example. A sleeping pad 22 is provided and housed within central recessed portion 18 and is supported by the base 14. The sleeping pad 22 or mattress may be made of any soft, supportive material for the infant to rest on and, desirably, completely cover the base 14 between the wall members 16 to cover the bottom of the central recessed portion 18. A resilient bumper member 24 is attached to and supported between the top 26 of the base 14 and the exterior 28 of the rigid wall members 16 as shown in FIG. 2. A cleanable cover 30 is sized to snuggly encompass the pad 22 and the resilient bumper member 24 and may be decorative if desired.

Figure 4:
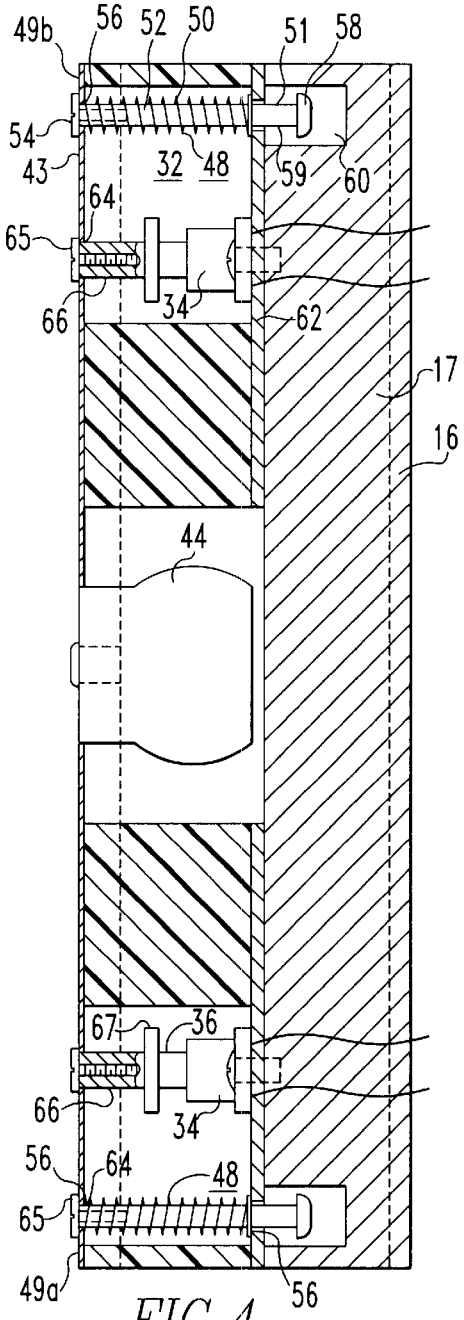
FIG. 4 is a cross-sectional view taken along the line 4—4 of FIG. 2, showing the switch members in the open or unactivated position.
Figure 5:
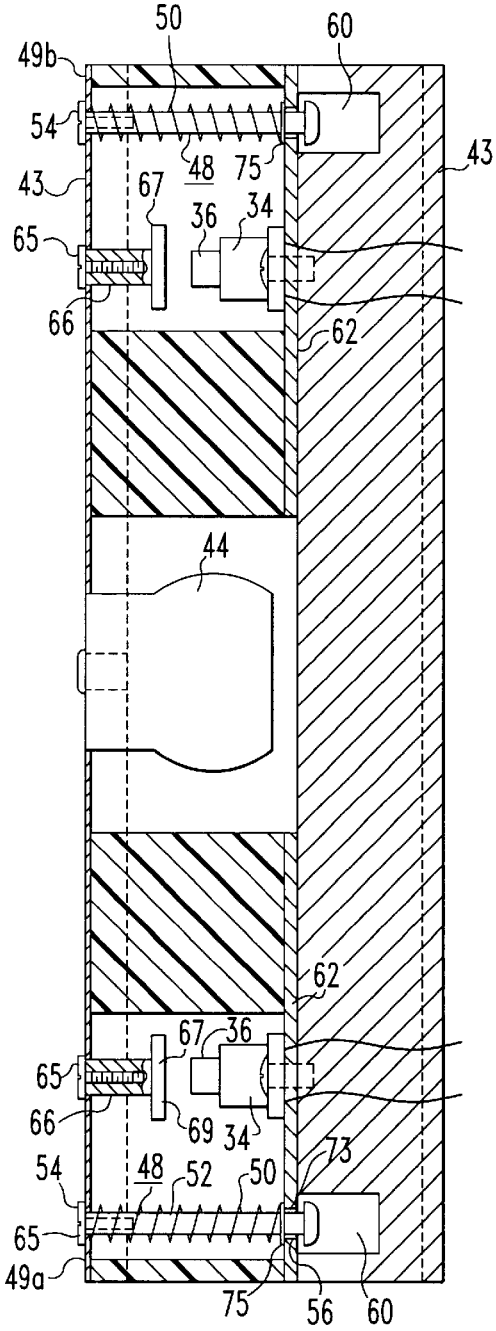
FIG. 5 is a cross-sectional view taken along the line 4—4 of FIG. 2 showing the switch members in the closed or activated position.

As shown in FIGS. 1 and 2, pressure sensitive switch assemblies 32 are provided and affixed to the wall members 16, at wall member extension 17. The switch assemblies 32 are housed within the resilient bumper member 24. The switch assemblies 32 include pressure sensitive switch members 34 attached to the wall members 16 at extension 17. The switch members 34 have a pressure sensitive portion 36. The switch assemblies 32 also include spring-loaded activation members 38. The activation members 38 include switch contact members 39 in operative alignment with the pressure sensitive portions 36 of the pressure sensitive switch members 34 as shown in FIGS. 4 and 5. An energy source 40 such as a 9-volt battery, is connected in circuit with the pressure sensitive switch members 34, as shown in FIG. 6.

Figure 6:
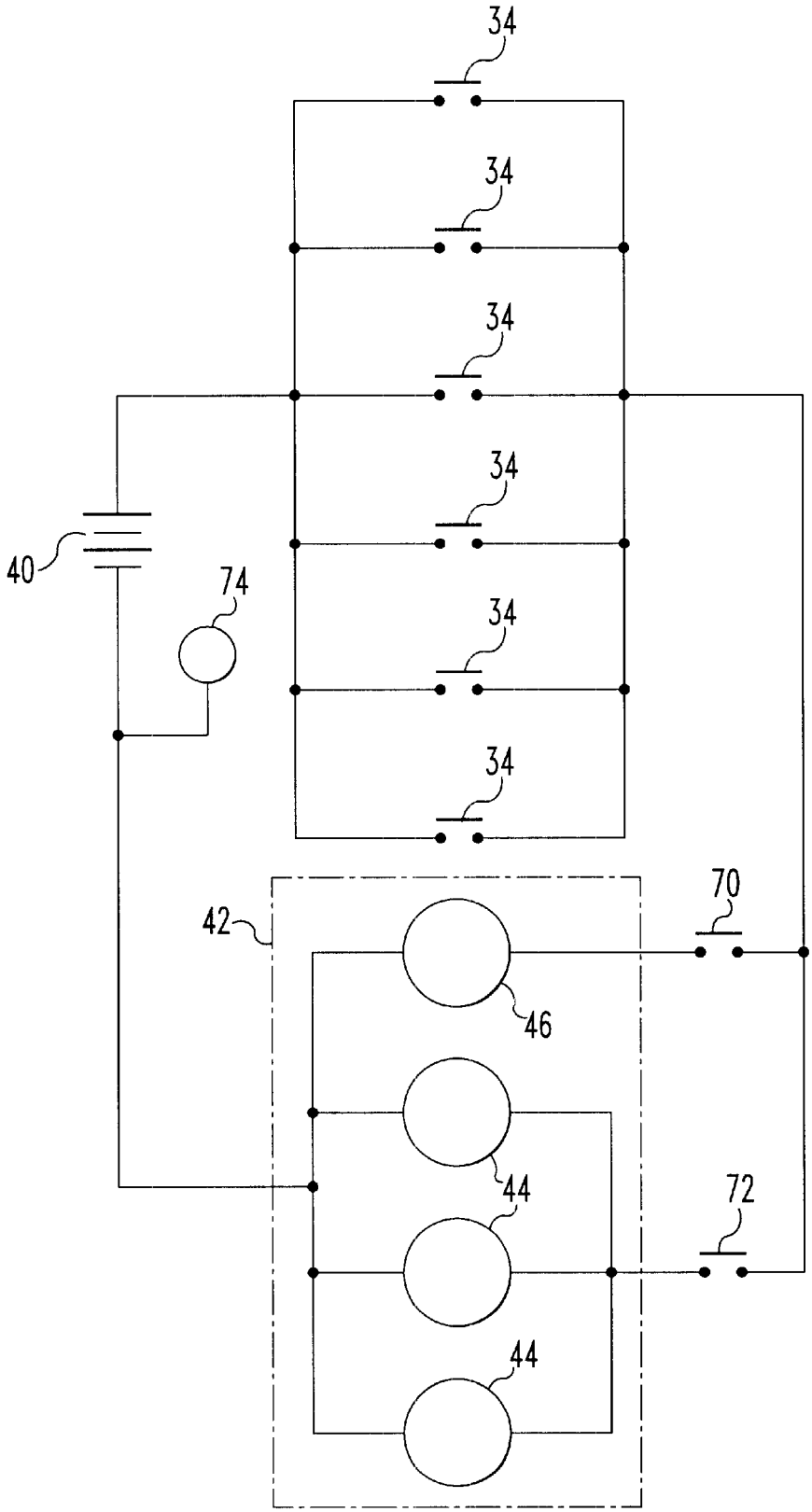
FIG. 6 is a schematic diagram showing the circuit arrangement of the present invention.

An alarm assembly 42 is connected in circuit with the pressure sensitive switch members 34 and the energy source 40 as shown in FIG. 6. Utilizing the portable infant protective bed of the present invention, when an infant is sleeping in the bed on the pad in close proximity to a sleeping adult and in the event the adult rolls over onto the resilient bumper member 24, the weight of the adult will cause the activation bar 38 to depress causing the switch contact members 39 to contact one or more of the pressure sensitive switch members 34, thereby causing the alarm assembly to activate to wake the adult to prevent injury to the infant. The infant bed is readily portable and may be laid on the adult's bed as the adult desires to have the infant sleeping in bed with the adult. Although the bed of the present invention is primarily for an infant sleeping with older persons, it may also be used to protect an infant from foot traffic of older children and pets.

Preferably, the rigid base 14 and wall member 16 of the frame 12 are rectangular, as shown in FIG. 1, of course other shapes may be used.

The alarm assembly 42 desirably includes motor-vibrator members 44 affixed to the spring-loaded activation bars 38 as shown in FIGS. 4 and 5. The motor-vibrator members 44 are connected in circuit with the pressure sensitive switch members 34 as shown in FIG. 6. This configuration provides, upon energization of the alarm assembly 42 by the activation of one of the activation bars 38 contacting the pressure sensitive mechanical contact portion 36 of one of the switch members 34 of the switch assembly 32 may cause the motor-vibrator members 44 to be activated to vigorously vibrate and wake the sleeping adult thereby preventing injury to the infant. The motor-vibrator members may be any 3 to 12 volt motor-vibrator such as, for example, that sold by Dandee International Ltd. The pressure sensitive switch members are springloaded push button type which may be that sold by Radio Shack™ model number 275-609A.

The spring-loaded switch activation members 38 also include an elongated rigid bar 43 which may have a U-shaped cross section as shown in FIG. 2 and may be 24 inches long and ⅝ inches wide and of the type sold by Home Depot, for example. In addition, the spring-loaded switch activation members 38 desirably include spring-loaded support members 48 attached to and positioned near the ends 49*a*, 49*b*. The elongated bars 43 are each positioned proximate the outer surface 25 of the resilient bumper member 24 in parallel relationship with one of the wall members 16.

The spring-loaded support members 48 each include coil spring 50 mounted between the wall member 16, at wall member extension 17, as shown in FIGS. 4 and 5, and rigid bar 43. A first tubular nut 52 having a first threaded interior surface, not shown. The first tubular nut 52 slideably passes through the coil spring 50 and is in coaxial alignment with it. A first machine screw 54 is engageable with the first threaded interior surface of the first tubular nut 52. The rigid bar 43 has a first aperture 56 proximate the ends 49*a*, 49*b*, as shown in. FIGS. 49*a* and 49*b*, for example. The first machine screw passes through the first aperture 56 and is engageable with the first threaded surface, not shown, of the first tubular nut 52. The first tubular nut 52 has a first blind heat 58 at one end 59. The wall members 16 each have a first opening 60 therein sized to receive the head 58 of the first nut 52. The wall members 16 each include a base plate 62 affixed thereto over the first opening 60. The base plate 62 has a second aperture 64 therethrough aligned with the first opening 60 of the wall members 16. The first tubular nut 52 slideably passes through the second aperture 64, whereby when the bar 43 is depressed the first tubular nut 52 is caused to travel thereby causing the switch contact member 39 to engage the pressure sensitive portion 36 of the switch member 34.

The switch contact members 39 each preferably include a second machine screw 65. A second tubular nut 66 is included having a second threaded interior surface, not shown, and a second blind head 67, affixed to one end of the second tubular nut 69, and engageable with the pressure sensitive portion 36 of the switch member 34. The rigid bar 43 has a third aperture 73 passing through it. The second machine screw 65 passes through the third aperture 73 of the rigid bar 43 and is engageable with the second threaded surface of the second tubular nut 66. Desirably a washer 75 is mounted between the spring 50 and the base plate 62.

The alarm assembly 42 preferably further comprises a loud-sound-emitting device 68 connected in circuit with the pressure sensitive switch members 34. The loud-sound-emitting device 68 may be a buzzer of the type sold by Radio Shack™ model number 273-060A, for example. When the alarm assembly 42 is caused to be energized by one of the activation members 38 contacting the pressure sensitive mechanical contact portion 36 of one of the pressure sensitive switch members 34 may cause the loud-sounding-emitting-device to be activated to wake a sleeping adult to prevent injury to an infant.

The alarm assembly 42 preferably further includes a loud-sound-emitting device enabling switch 70 connecting the circuit with a loud-sound-emitting device 46 as shown in FIG. 6. This permits the loud-sound-emitting device 46 to be used as part of the alarm assembly as desired. When the switch is activated the loud-sound-emitting device may be activated upon activation of the pressure sensitive assembly 32. Also, the alarm assembly 42 preferably further includes a motor-vibrator member enabling switch 72 connected in circuit with a motor-vibrator member 44 as shown in FIG. 6. Enabling switch 72 permits the motor-vibrator members 44 to be used as part of the alarm assembly as desired. A low battery warning light 74 preferably is also included in the alarm assembly 42 and is connected in circuit as shown in FIG. 6 with the energy source 40. The low battery warning light may be a light emitting diode with appropriate circuit, as is well known in the art.

Preferably, the resilient bumper member 24 has a sloped adult contact surface portions 76 of a predetermined slope in position around the central recess portion 18. Preferably, the slope of the slope contact portions 76 is from about 35 degrees to about 55 degrees from the vertical. In the embodiment shown in FIGS. 1–5, wall members 16 are perpendicular to the base 14, wall member extension 17 has a right-triangle cross-section with the hypotenuse approximating the same slope as the slope contact portions 76. Of course the bumper member could have a curved cross section to approximate the slope of the sloped contact portions 76. Preferably the upper surface 78 of the sloped contact portion 76 are coplanar as shown in FIG. 2. The bumper member 24 preferably includes a resilient polyurethane foam. The sides 80 of bars 43 are affixed to the resilient polyurethane foam of the bumper member by an adhesive such as contact adhesive. The bumper member 24 has voids 82 provided therein in predetermined position. The switch members 34 and other components of the present invention may be housed within the voids 82, as shown in FIG. 2. Compartment 84 shown in FIG. 1 is a void used to house components. Preferably the base 14 is rectangular.

The present invention provides that upon activation of the switch members 34 either the loud-sound-emitting device 46 or the motor-vibrators may be activated or both may be activated depending on whether the switches 70, 72 are enabled. Not only will the device be activated when an adult rolls onto the bumpers, but it may also be activated should the infant attempt to crawl out of the bed or if some other object or pet should contact the bumper 24.

What is claimed is:

1. A portable infant protective bed comprising:

a frame including a rigid base and rigid wall members affixed to said base to form a central recessed portion, said base also having a rigid exterior lip portion extending outwardly from said rigid wall members, a sleeping pad housed within said central recessed portion and supported by said base, a resilient bumper member affixed to and supported between the top of said rigid exterior lip portion of said base and the exterior of said rigid wall members, a cleanable cover sized to snuggly encompass said pad and said resilient bumper member, pressure sensitive switch assemblies affixed to said wall members and housed within said resilient bumper member, said pressure sensitive switch assemblies including pressure sensitive switch members affixed to said wall members, said switch members having a pressure sensitive portion, said switch assemblies also including spring-loaded switch activation members, said activation members including switch contact members in operative alignment with said pressure sensitive member portions of said switch members, an energy source connected in circuit with said pressure sensitive switch members, an alarm assembly connected in circuit with said pressure sensitive switch members and said energy source, whereby when an infant is sleeping in said bed on said pad in close proximity to a sleeping adult and in the event said adult rolls over onto said resilient bumper member, the weight of said adult will cause at least one of said activation members to depress causing said switch contact members to contact one or more of said pressure sensitive switch members, thereby causing said alarm assembly to activate to wake said adult to prevent injury to said infant.

2. The bed of claim 1, wherein said spring-loaded switch activation members further include an elongated rigid bar, spring-loaded support members affixed to and disposed proximate the ends thereof, said elongated bars each positioned proximate said outer surface of said resilient bumper member in parallel relationship with one of said wall members.

3. The bed of claim 2, wherein said spring-loaded support members each include a coil spring mounted between said wall members and said rigid bars, a first tubular nut having a first threaded interior surface, said first tubular nut slideably passing through said coil spring and in coaxial alignment therewith, a first machine screw engageable with said first threaded interior surface of said first tubular nut, said rigid bar having a first aperture therethrough proximate the ends thereof, said first machine screw passing through said first aperture and engageable with said first threaded surface of said first tubular nut, said first tubular nut having a blind head at one end thereof, said wall members each having an opening therein sized to receive the head of said first tubular nut, a base plate affixed to said wall member over said opening, said base plate having a second aperture therethrough, said first tubular nut slideably passing through said second aperture, whereby when said bar is depressed said first tubular nut is caused to travel thereby causing said switch contact member to engage said pressure sensitive portion of said switch member.

4. The bed of claim 3, wherein said switch contact members each comprises a second machine screw, a second tubular nut having a second threaded interior surface and a second blind head affixed to one end thereof engageable with said pressure sensitive portion of said switch member, said rigid bar having a third aperture passing therethrough, said second machine screw passing through said third aperture of said rigid bar and engageable with said second threaded surface of said second tubular nut.

5. The bed of claim 2, wherein said alarm assembly comprises motor-vibrator members affixed to said elongated bars, said motor-vibrator members are connected in circuit with said pressure sensitive switch members, whereby when said alarm assembly is energized by one of said bars being depressed and causing at least one of said switch contact members to contact said pressure sensitive portion of one of said switch members of said switch assemblies may cause said motor-vibrator member to be activated to wake said sleeping adult.

6. The bed of claim 5, wherein said alarm assembly further comprises a motor-vibrator member enabling switch connected in circuit with said motor-vibrator members, whereby said motor-vibrator members may be used as part of the alarm assembly as desired.

7. The bed of claim 2, wherein said alarm assembly further comprises a loud-sound-emitting device connected in circuit with said pressure sensitive switch members, whereby when said alarm assembly is energized by one of said activation bars being depressed and causing one of switch contact members to contact said pressure sensitive portion of one of said pressure sensitive switch members may cause said loud-sound-emitting device to be activated to wake said sleeping adult.

8. The bed of claim 7, wherein said alarm assembly further comprises a loud-sound-emitting device enabling switch connected in circuit with said loud-sound-emitting device, whereby said loud-sound-emitting device may be used as part of said alarm assembly as desired.

9. The bed of claim 2, wherein said bumper member has sloped adult contact surface portions of predetermined slope in position around said central recessed portion.

10. The bed of claim 9, wherein said slope of said sloped contact portions is from about 35 degrees to about 55 degrees from the vertical.

11. The bed of claim 9, wherein the upper surface of said elongated activation bars and said sloped contact portions of said bumper member are coplanar.

12. The bed of claim 11, wherein said bumper member comprises a resilient polyurethane foam.

13. The bed of claim 12, wherein the sides of said activation bars are affixed to said resilient polyurethane foam of said bumper member.

14. The bed of clam 13, wherein contact adhesive affixes the sides of said activation bars to said resilient polyurethane foam of said bumper member.

15. The bed of claim 14, wherein said bumper member has voids provided therein in predetermined position.

16. The bed of claim 15, wherein said base is rectangular.

17. The bed of claim 1, wherein said alarm assembly further comprises a low battery warning light connected in circuit with said energy source.

18. The bed of claim 1, wherein said energy source is a battery.

* * * * *